United States Patent [19]

Tanaka

[11] 4,026,036

[45] May 31, 1977

[54] APPARATUS FOR CONTROLLING TEMPERATURE ON A DRYING MACHINE FOR RUNNING YARN SHEETS

[75] Inventor: Masayoshi Tanaka, Kanazawa, Japan

[73] Assignee: Tsudakoma Kogyo Kabushiki Kaisha, Japan

[22] Filed: July 31, 1975

[21] Appl. No.: 600,646

[30] Foreign Application Priority Data

June 6, 1975 Japan ..... 5067486

[52] U.S. Cl. ..... 34/54; 34/66; 34/155; 34/223

[51] Int. Cl.[2] ..... F26B 21/04

[58] Field of Search ..... 34/52, 54, 48, 49, 155, 34/219, 223, 66, 67, 45

[56] References Cited

UNITED STATES PATENTS

| | | | |
|---|---|---|---|
| 2,955,342 | 10/1960 | Litzler | 34/54 |
| 3,085,347 | 4/1963 | Justus | 34/54 |
| 3,283,414 | 11/1966 | Crouzet | 34/77 |
| 3,875,680 | 4/1975 | Back et al. | 34/67 |

*Primary Examiner*—John J. Camby
*Assistant Examiner*—Larry I. Schwartz
*Attorney, Agent, or Firm*—Ostrolenk, Faber, Gerb & Soffen

[57] ABSTRACT

In a box-type continuous hot air drying machine having a drying chamber through which yarn sheets are processed, the supply rate of thermal energy into the drying chamber is automatically controlled in accordance with the running condition of the drying machine, i.e., high speed running, low speed running and stoppage of the drying machine. Preferably cool air under pressure is introduced into the drying chamber when the machine stops running for accelerated cooling of the air and the yarn sheet in the drying chamber.

11 Claims, 10 Drawing Figures

APPARATUS FOR CONTROLLING TEMPERATURE ON A DRYING MACHINE FOR RUNNING YARN SHEETS

BACKGROUND OF THE INVENTION

The present invention relates to apparatus for controlling temperature on a drying machine for running yarn sheets, and more particularly relates to apparatus which, on a continuous hot air type drying machine for running yarn sheets usually annexed to such a textile processing machine as a sizing machine, controls properly and fully automatically the inside temperature of the machine in accordance with the varying running conditions of the machine.

Generally, in conventional continuous hot air type drying machines for yarn sheets after sizing, the supply rate of hot air into the drying chambers, in other words the supply rate of thermal energy into the drying chambers, is maintained substantially constant irrespective of the running condition of the machine, i.e., high speed running, low speed running and stoppage of the running.

This constant supply rate system naturally causes differences in the drying effect on the yarn sheet in accordance with the difference in the running condition of the yarn sheet. Therefore, when the yarn sheet is processed through the drying machine at relatively high and relatively low speeds occurring alternately, there will be produced a considerable fluctuation in the drying effect on the yarn sheet in the lengthwise direction thereof. Such fluctuation in the drying effect along the length of the yarn sheet often tends to cast an ill influence upon the processing of the yarn sheet in the subsequent process steps. For example, when such a longitudinal fluctuation appears on the yarn sheet during the drying process and after sizing, frequent yarn breakages will occur in the subsequent weaving process and such frequent yarn breakages inevitably lead to degraded quality of the resulting products, lowered operational efficiency of the weaving process and seriously increased labour necessary for fixing of the yarn breakages and removal of defects appearing on the final products.

The constant supply rate system is accompanied with further drawbacks, i.e., loss of thermal energy, causing undesirable lowering of thermal efficiency in the drying operation. That is, under some situations, an unnecessarily excessive quantity of thermal energy is supplied into the drying chamber.

The primary object of the present invention is to provide an apparatus capable of freely adjusting the supply rate of thermal energy into the drying chamber in accordance with the running condition of the drying machine, thereby eliminating the above-described drawbacks inherent to the continuous hot air type drying machines of the conventional type.

Another problem arising in connection with the continuous hot air type drying machine is the condition of the yarn sheet within the drying chamber when the machine stops running. As the machine stops running, the yarn sheet naturally stops running and some longitudinal portion thereof remains at a standstill within the drying chamber. On the other hand, as hot air has been supplied into the drying chamber continuously throughout running of the machine, air of a relatively high temperature remains in the drying chamber just after the machine has stopped running. Such hot air may cause fatal thermal damage to the portion of the yarn sheet remaining at a standstill in the drying chamber. Therefore, it is preferable to lower the temperature of the air in the drying chamber as quickly as possible after the machine has stopped running.

It is another object of the present invention to provide an apparatus capable of positively lowering the temperature of the air and the portion of the yarn sheet in the drying chamber as quickly as possible just after the drying machine has stopped running.

BRIEF DESCRIPTION OF THE INVENTION

In order to attain the above-described object, the apparatus of the present invention is provided with the following basic construction. That is, an air suction duct opens on one side, more preferably on the yarn feed side in the bottom of a drying chamber confined in an elongated box type framework and this suction duct branches out on the downstream side thereof into an air exhaust duct and an air circulation duct. A deflector is disposed at the junction of the three ducts in such an arrangement as to selectively establish a communication between the suction duct and one of the remaining two ducts by virtue of its swingable mounting.

In a preferred embodiment of the present invention, the above-described air circulation duct is connected to and opens on the other side of the chamber, more preferably on the yarn sheet delivery side and in the bottom of the drying chamber via a heater and a circulation fan. A deflector for adjusting the flow rate of the circulating air is disposed in the circulation duct and, an additional deflector is disposed at the junction of the circulation duct to the drying chamber. A cool air supply assembly including a supply duct and fan is annexed to the drying chamber on the underside of the yarn sheet outlet of the framework.

In another preferred embodiment of the present invention, the circulation duct is coupled to the drying chamber in the same manner as described hereinabove and is provided with a similar deflector for adjusting the flow rate of the air in the circulation duct. A cool air supply duct is joined to the circulation duct at a location between the heater and the circulation fan and a deflector is swingably disposed at the junction of the two ducts.

In the other preferred embodiment of the present invention, the circulation duct, which is related to the drying chamber in the same way as the foregoing, is accompanied with a return duct connected thereto at a position upstream of the heater and at a position downstream of the circulation fan.

The deflectors used in the present invention may be operated manually or connected operationally to a mechanism for governing the running condition of the drying machine. It is also preferable that the upper cover of the framework should open automatically when the machine stops running.

The words "upstream" and "downstream" are used in this specification in connection with the flowing direction of air along a give course.

BRIEF DESCRIPTION OF THE FIGURES

Further features and advantages of the present invention will be made clearer from the following description, reference being made to the embodiments shown in the accompanied drawings, in which.

DETAILED DESCRIPTION OF THE INVENTION

Figure 1:
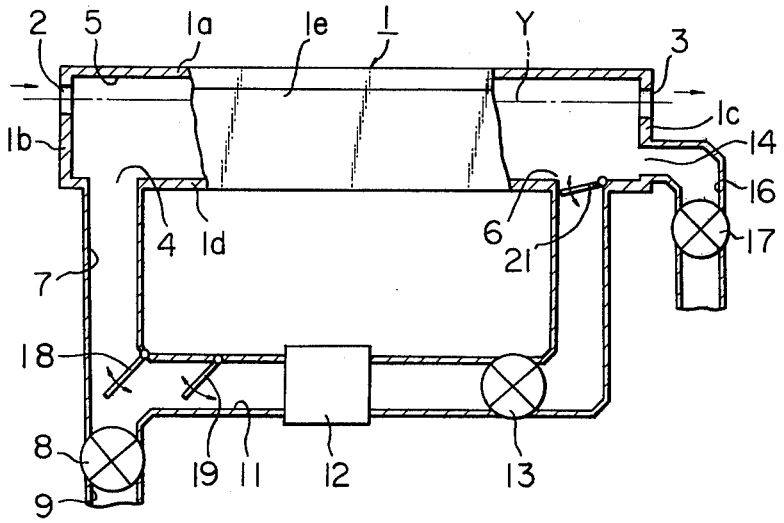
FIG. 1 is a side plan view, partly in section, of the first embodiment of the present invention.

An embodiment of the apparatus according to one aspect of the present invention is shown in FIG. 1, in which a drying chamber 5 is confined within a box-type framework 1 comprised of an upper cover 1*a*, a feed side end wall 1*b*, a delivery side end wall 1*c*, a bottom wall 1*d* and two side walls 1*e*.

A slit-type inlet 2 for a yarn sheet Y is formed through the end wall 1*b* on the feed side transversely in the width direction of the drying chamber 5. Likewise, a slit-type outlet 3 for the yarn sheet Y is formed through the end wall 1*c* on the delivery side.

Although not shown in the drawing, a number of guide rollers are provided within the drying chamber 5, on the upstream side of the yarn sheet inlet 2 and on the downstream side of the yarn sheet outlet 3 in order to properly guide the run of the yarn sheet Y through the drying chamber 5.

At a position close to the feed side end wall 1*b*, an air suction port 4 is formed through the bottom wall 1*d* of the framework 1 which is connected to an exhaust duct 9 via a suction duct 7 and a conventional exhaust fan 8 mounted in duct 9. The suction duct 7 branches off into an air circulation duct 11 at a position somewhat upsteam of the exhaust fan 8. This air circulation duct 11 communicates with an air ejection port 6 formed through the bottom wall 1*d* of the framework 1 at a position close to the delivery side end wall 1*c* via a heater 12 and an air circulation fan 13 which is located somewhat downstream of the heater 12.

A first swingably mounted deflector 18 is provided at the junction of the three ducts 7, 9 and 11 in such an arrangement that its turning selectively establishes a communication of the suction duct 7 with the exhaust duct 9 or of the suction duct 7 with the circulation duct 11. Further, a second swingably mounted deflector 19 for adjusting the flow rate of the air through the circulation duct 11 is provided in the circulation duct 11 at a suitable position. The air ejection port 6 is accompanied with a third swingably mounted deflector 21 which, by its turning, controls the flow of the air through the ejection port 6.

The above-mentioned three sets of deflectors 18, 19 and 21 are turned either manually or by any suitable automatic driving means (not shown) indicated by the double-headed arrows, respectively.

In addition to the above-described construction, the apparatus is further provided with a cool air ejection port 14 formed through the delivery side end wall 1*c* below the yarn sheet outlet 3, and communicating with a cool air supply duct 16 via a cool air supply fan 17 of an ordinary type.

Similar to the inlet 2 and outlet 3, the above-mentioned ports 4, 6 and 14 are of a slit-type and extend transversely in the width direction of the walls through which they are formed.

Most of the above-described arrangements relating to the air circulation system and the cooling system are incorporated in a stand not shown in the drawing and supporting the framework 1 thereon at normal operation level.

As already mentioned, the running condition of the drying machine for the yarn sheet is classified into three states, i.e., a high speed running state, a low speed running state and stoppage of running.

Figure 2A:
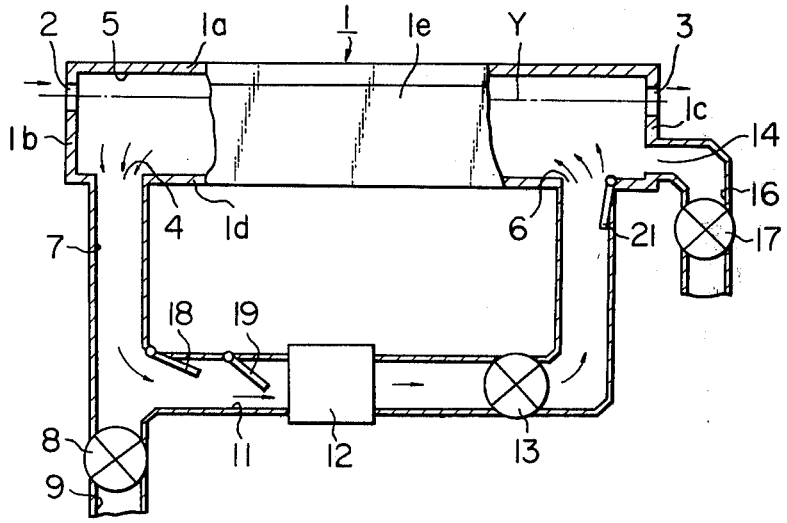
FIG. 2A is a side plan view, partly in section, of the apparatus shown in FIG. 1 in the disposition when the drying machine is running.

The disposition during the high and low speed runnings of the drying machine is shown in FIG. 2A. In this disposition, the exhaust fan 8 stops its operation, the first deflector 18 opens fully in order to establish a free communication of the suction duct 7 to the circulation duct 11, the third deflector 21 opens fully in order to establish communication of the circulation duct 11 with the drying chamber 5 and the cool air supply fan 17 halts its operation. The second deflector 19 opens over a larger extent in order to allow the air to flow at a high flow rate in the case of the high speed running of the machine whereas it opens over a smaller extent in order to allow the air to flow at a low flow rate in the case of the low speed running of the machine.

By preparing the apparatus in the above-described manner, the entire system is so arranged as to allow circulation of the hot air only, with no exhaustion of the hot air and a cut-off of the supply of the cool air.

After the preparation is completed, the heater 12 and the circulation fan 13 are driven for operation, by which the air in the drying chamber 5 is sucked into the suction duct 7 through the suction port 4 formed in the bottom wall 1*d* of the framework 1. The air entering duct 7 is then conducted into the framework 1. The air entering duct 7 is then conducted into the circulation duct 11, heated to a prescribed temperature during its passage through the heater 12 and again supplied into the drying chamber 5 via the ejection port 6 by the operation of the circulation fan 13 as shown with arrows in the drawing.

During this circulation, the air loses its thermal energy for drying of the yarn sheet Y in the drying chamber 5 and additional thermal energy, whose quantity is almost equal to that of the thermal energy lost during the drying process, is bestowed to the air during its travel through the heater 12. Continuous drying of the running yarn sheet Y is carried out by the repeated circulation of the air in the above-described fashion.

As a variation of the above-described procedure, it is also possible to drive the exhaust fan 8 at an output somewhat smaller than that at the time of full operation. In this case, a part of air sucked into suction duct 7 is discharged out of the system through the exhaust duct 9. Then, as a compensation for the air so exhausted, new fresh air of less humid nature is sucked into the drying chamber 5 from outside. This clearly mitigates accumulation of humidity in the circulating air. This procedure is recommended especially when the yarn sheet contains a high degree of moisture.

Figure 2B:
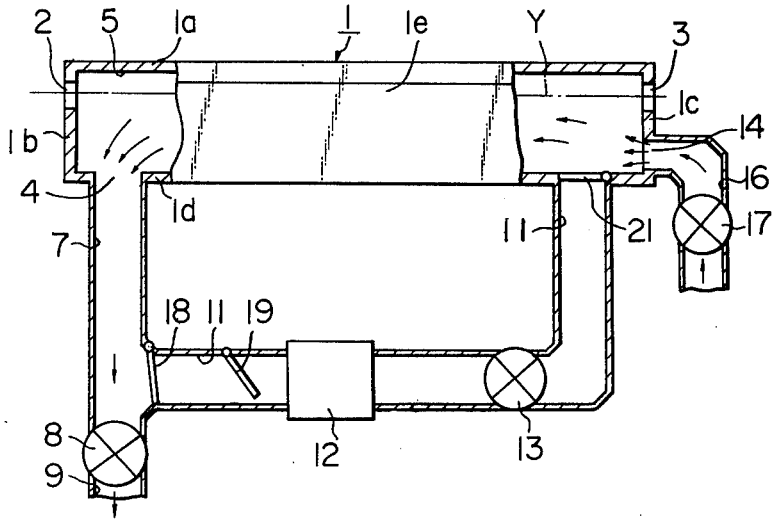
FIG. 2B is a side plan view, partly in section, of the apparatus shown in FIG. 1 in the disposition just after the drying machine has stopped running.

The disposition when the drying machine stops running is shown in FIG. 2B. In this disposition, the exhaust fan 8 is driven for operation, the first deflector 18 closes in order to cut off the communication of the suction duct 7 with the circulation duct 11, thereby establishing communication between the suction duct 7 and the exhaust duct 9; the third deflector 21 closes in order to cut off the communication between the circulation duct 11 and the drying chamber 5 and the cool air supply fan 17 is driven for operation. Hence, the air circulation line is isolated from the drying chamber 5 and the heater 12 and the circulation fan 13 stop operations.

As a result of the above-described operational setting of the apparatus, cool air is positively introduced into the drying chamber 5 through the supply duct 16 and the ejection port 14 by the operation of the supply fan 17. The cool air so introduced on the one hand lowers the temperature of the air prevailing in the drying chamber 5 to a level at which no thermal damage will be caused to the yarn sheet Y in the drying chamber 5 and, on the other hand, directly contacts the yarn sheet Y in the drying chamber 5 in order to cool it down quickly. These cooling operations are carried out during the travel of the ejected cool air along the yarn sheet Y in the drying chamber 5 from the delivery to the feed side thereof. Upon arrival at the feed side terminal of the drying chamber 5, the cool air is sucked into the suction duct 7 via the suction port 4 due to the suction by the exhaust fan 8, and is discharged out of the system through the exhaust duct.

The air exhausted from the drying chamber 5 is at a higher temperature than that of the cool air supplied from the ejection port 14 as it has absorbed thermal energy from the hot air remaining in the drying chamber 5 and from the yarn sheet Y in the drying chamber 5. However, in case when the temperature of the air discharged out of the drying chamber 5 is still lower than that of the air in the atmosphere, the air so discharged may be advantageously recycled to the supply source of the cool air, to which the supply duct 16 is connected, in order to save the running cost of the apparatus for production of the cool air.

Figure 3:
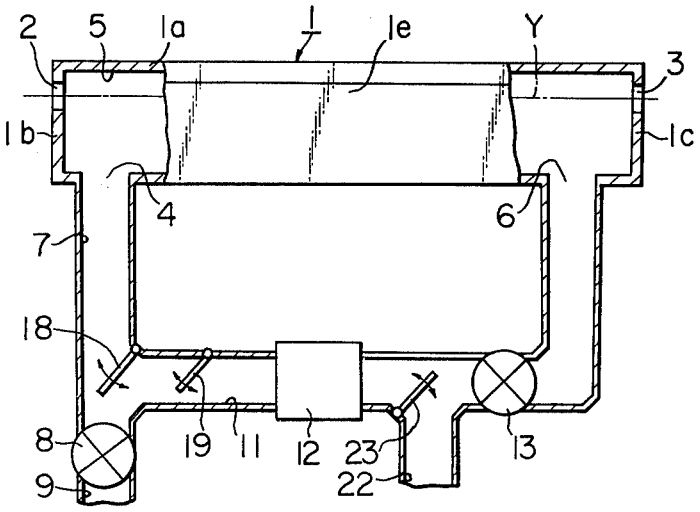
FIG. 3 is a side plan view, partly in section, of the second embodiment of the present invention.

Another embodiment of the apparatus according to another aspect of the present invention is shown in FIG. 3, in which elements substantially similar in construction to those used in the first embodiment shown in FIG. 1 are designated with similar reference numerals and symbols.

In the case of this embodiment, the third deflector 21 arranged at the air ejection port 6 is omitted and a cool air supply duct 22 communicates with the circulation duct 11 at a position between the heater 12 and the circulation fan 13, whereby the duct 22 now serves as the cool air supply previously provided by duct 16 opening in the delivery side end wall 1*c* of the framework 1 in the first embodiment. A swingable third deflector 23 is provided at the junction of the two ducts 11 and 22 in such an arrangement as to selectively establish or cut off the communication between the two ducts 11 and 22. This deflector 23 may be operated in the same manner as the other deflectors 18 and 19, i.e., manually or automatically.

Figure 4A:
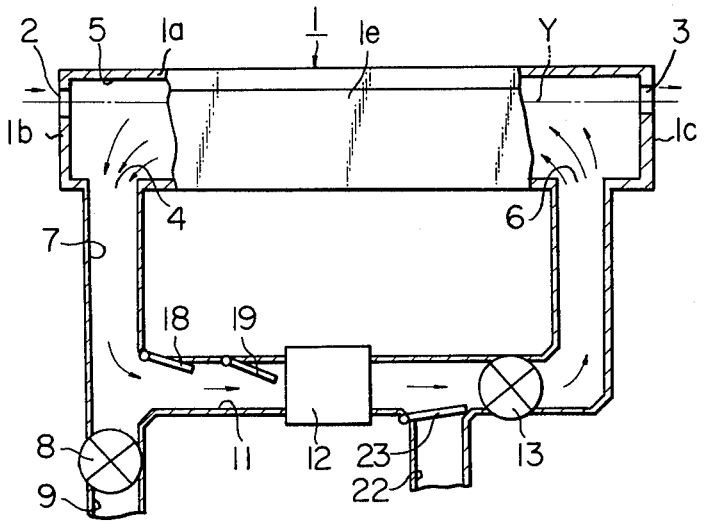
FIG. 4A is a side plan view, partly in section, of the apparatus shown in FIG. 3 in the disposition when the drying machine is running.

The disposition during the high speed or low speed running of the drying machine is shown in FIG. 4A. The extent of the opening of the second deflector 19 is adjusted in accordance with the running speed of the drying machine as in the case of the first embodiment. Further, operational settings of the exhaust fan 8, the first deflector 18 and the heater 12 are quite the same with those in the first embodiment. In this disposition, the third deflector 23 is so turned as to cut off the communicaton between the both ducts 11 and 22.

As the circulation fan 13 is driven for operation, the air circulates between the drying chamber 5 and the heater 12 through the ducts 7 and 11 as in the disposition shown in FIG. 2A in order to carry out the continuous drying of the running yarn sheet Y.

Figure 4B:
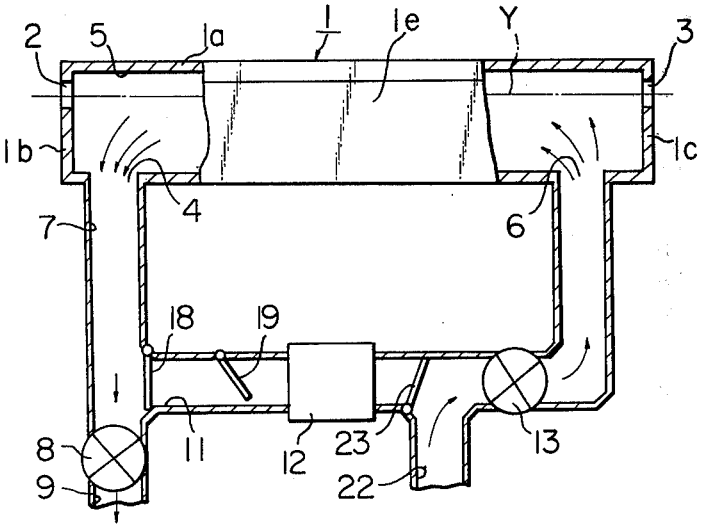
FIG. 4B is a side plan view, partly in section, of the apparatus shown in FIG. 3 in the disposition just after the drying machine has stopped running.

When the drying machine has stopped running, the first deflector 18 is so moved as to cut off communication between the suction duct 7 and the circulation duct 11 in order to connect the former to the exhaust duct 9. Concurrently with this, the third deflector 23 closes the passage in the duct 11 to the heater and establishes a communication between the cool air supply duct 22 and the circulation duct 11 as shown in FIG. 4B.

As the exhaust fan 8 is driven for operation after the above-described operational setting is completed, the operation of the circulation fan 13 being continued without interruption, the cool air from the supply source, to which the supply duct 22 is connected, is introduced into the drying chamber 5 via the ducts 22 and 11 by the operation of the circulation fan 13 and, as in the previous embodiment, lowers the temperature of the hot air remaining in the chamber 5 and, concurrently, cools down the yarn sheet Y in the chamber 5.

Upon arrival at the feed side terminal of the chamber 5, the air which has absorbed the thermal energy in the chamber 5 is sucked into the suction duct 7 through the suction port 4 and discharged off the system via the exhaust duct 9 by the operation of the exhaust fan 8.

Figure 5:
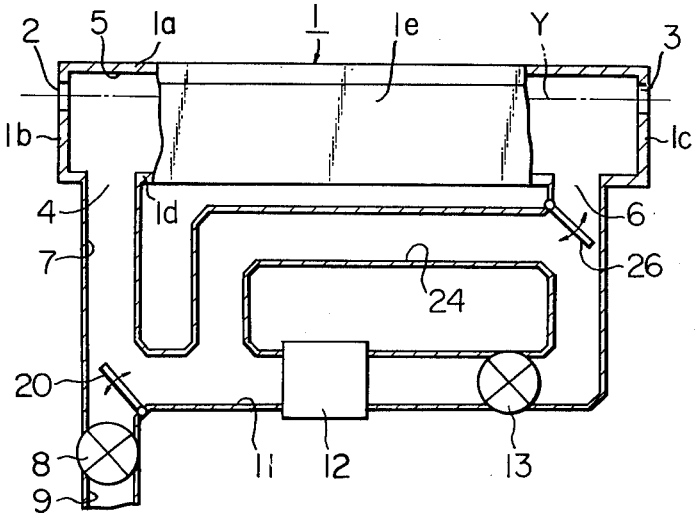
FIG. 5 is a side plan view, partly in section, of the third embodiment of the present invention.

The other embodiment of the apparatus according to the other aspect of the present invention is shown in FIG. 5, in which elements substantially similar in construction to those used in the preceding embodiments are designated with similar reference numerals and symbols, too.

In the case of this embodiment, only two sets of deflectors 20 and 26 are used in order to control the drying operation. That is, the first deflector 20 is provided at the junction of the suction duct 7 and the circulation duct 11 in such a swingable arrangement as to selectively cut off the communication between the suction and exhaust ducts 7 and 9.

In addition to the first deflector 20, there is provided a return duct 24 one end of which is joined to the circulation duct 11 at a position somewhat upstream of the heater 12 and the other end of which is joined to the circulation duct 11 at a position slightly upstream of the ejection port 6.

The second deflector 26 is provided at the junction between the two ducts 11 and 24 on the downstream side of the circulation fan 13 in such an arrangement that it controls flow rates of the air flowing into the drying chamber 5 and into the return duct 24 by its turning.

Manipulation of the deflectors 20 and 26 are carried out in a manner similar to those of the deflectors used in the preceding embodiments.

Figure 6A:
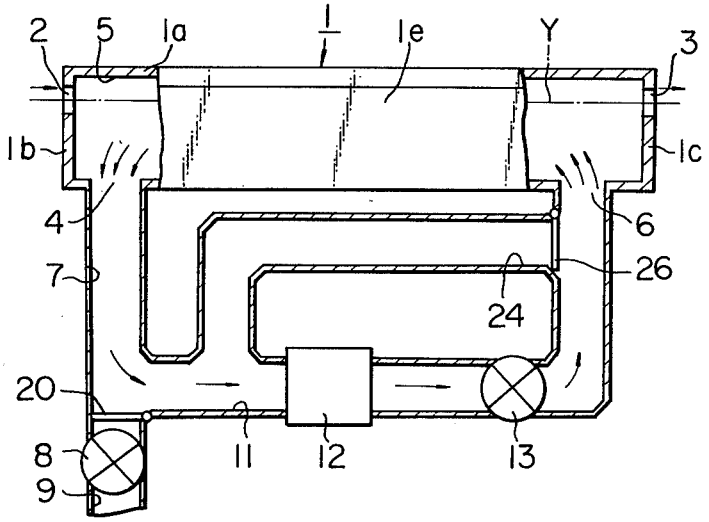
FIG. 6A is a side plan view, partly in section, of the apparatus shown in FIG. 5 in the disposition when the drying machine runs at a high speed.

The disposition during the high speed running of the drying machine is shown in FIG. 6A. In this disposition, the first deflector 20 is so turned as to cut off communication between the suction and exhaust ducts 7 and 9 while establishing unimpeded communication of the suction duct 7 with the circulation duct 11. In accordance with this arrangement, the second deflector 26 is so turned as to cut off the communication between the circulation and return ducts 11 and 24 on the downstream side of the circulation fan 13, whereby the circulation duct 11 is in unimpeded communication with the drying chamber 5.

As the circulation fan 13 is driven for operation after this operational setting, the air circulates between the drying chamber 5 and the heater 12 through the ducts 7 and 11 for drying of the running yarn sheet Y. As the hot air delivered from the heater 12 is fully supplied into the drying chamber 5, the supply rate of thermal energy into the chamber 5 is large enough to carry out sufficient drying of the yarn sheet Y even when the latter passes through the drying chamber 5 at a high speed within a short period.

Figure 6B:
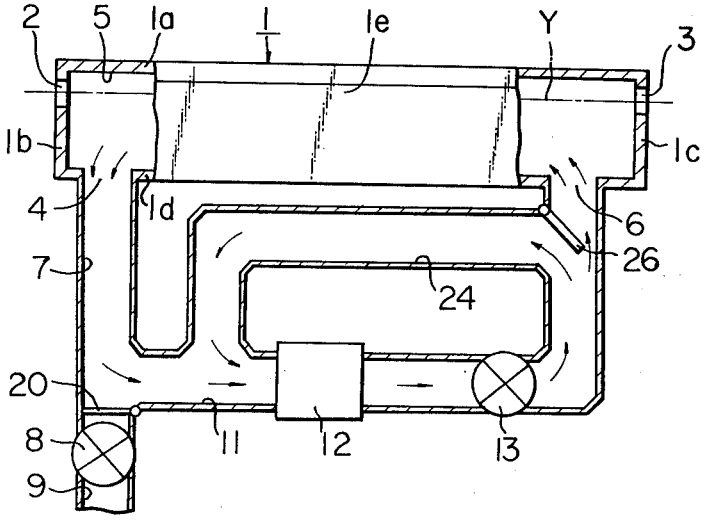
FIG. 6B is a side plan view, partly in section, of the apparatus shown in FIG. 5 in the disposition when the drying machine runs at a low speed.

The disposition during the low speed running of the drying machine is shown in FIG. 6B. In this disposition, the first deflector 20 is in the same position employed during high speed running whereas the second deflector 26 is arranged so as to introduce a part of the hot air flow from the heater 12 into the return duct 24. By this division of the air flow, the flow rate of the hot air supplied into the drying chamber 5 is reduced as compared with that during the high speed running of the drying machine. That is, the amount of thermal energy supplied into the drying chamber per unit period is reduced. Thanks to this reduction in the unit thermal energy supply, overheating of the yarn sheet Y can effectively be prevented even when the yarn sheet Y passes through the drying chamber over a relatively long period. The part of the hot air flowing into the return duct 24 joins the air flow from the suction duct 7 at the junction of the return duct 24 with the circulation duct 11 on the upstream side of the heater 12 and is passed to the heater 12 for re-heating.

Although the communication between the suction duct 7 and the exhaust duct 9 is cut off in the dispositions shown in FIGS. 6A and 6B by turning of the first deflector 20, the same result may be obtained without cutting-off. In such a case, the communication between the suction duct 7 and the circulation duct 11 is cancelled or minimized properly and the air discharged off the drying chamber 5 may be driven off the system through the exhaust duct 9 by appropriate operation of the exhaust fan 8.

Figure 6C:
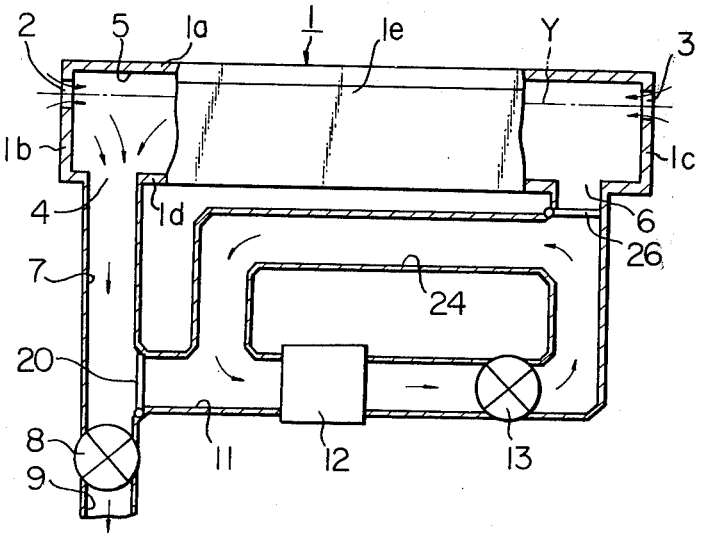
FIG. 6C is a side plan view, partly in section, of the apparatus shown in FIG. 5 in the disposition just after the drying machine has stopped running.

When the drying machine stops running, the entire arrangement assumes the disposition shown in FIG. 6C. In this disposition, the first deflector 20 is so turned as to fully cut off communication between the suction duct 7 and the circulation duct 11 and the suction duct 7 now is in unimpeded communication with the exhaust duct 9. The second deflector 26 is so turned also as to cancel the communication of the circulation duct 11 to the drying chamber 5.

As the exhaust duct 8 is driven for operation under this condition, the hot air prevailing in the drying chamber 5 is discharged off the system through the exhaust duct 9. Due to this air discharge, the atmospheric pressure in the drying chamber 5 is rendered negative because no air is supplied from the circulation duct 11 and this lowering of the pressure naturally causes suction of outside air of relatively low temperature into the drying chamber 5 through the inlet 2 and the outlet 3. The air so sucked into the drying chamber 5 accelerates lowering of the temperature in the drying chamber 5 and cooling of the yarn sheet Y in the drying chamber 5.

As a variation of the above-described procedure, the exhaust fan 8 may be driven for rotation in the opposite direction. In this case, the outside air is positively fed into the chamber 5 via the ducts 9 and 7 and the port 4 in order to lower the temperatures of the air and the yarn sheet Y in the chamber 5.

Meanwhile the heater 12 and the circulation fan 13 may either stop or continue their operations. In the former case, there is no substantial movement of air in the circulation and return ducts 11 and 24 whereas, in the latter case, the hot air circulates through the ducts 11 and 24 and the heater 12 without any substantial influence upon the thermal condition in the drying chamber 5.

In the dispositions shown in FIGS. 2B and 4B in which the drying machine stops running, it is preferable that the upper cover 1*a* of the framework 1 should be opened either manually or automatically for quick introduction of the outside air of relatively low temperature into the drying chamber 5. Such quick introduction of the outside air will effectively accelerate temperature lowering in the drying chamber 5 and cooling of the yarn sheet Y.

Drive means for the deflectors and fans may preferably be connected operationally to means for governing the running of the drying machine.

In the case of the illustrated embodiments, the yarn sheet Y runs from the inlet 2 to the outlet 3. However, in the practice of this invention, the yarn sheet Y may run through the drying chamber in the opposite direction, too.

As is clear from the above explanation, employment of the present invention in the drying system of running yarn sheets assures uniform drying along the length of the yarn sheets as the unit supply rate of thermal energy into the drying chamber can be freely adjusted in accordance with the running condition of the drying machine.

Therefore, the processed yarn sheets, e.g. dried sized yarn sheets, experience little deviation in the drying effect along the length thereof and this absence of deviations in the drying effect assures improved weaving operation while resulting in enhanced quality of the products remarkable escalation in the process efficiency.

In addition, effective re-utilization of the thermal energy provided by the heater results in considerably increased thermal efficiency of the drying machine.

Further, the positive and quick lowering of the temperature in the drying chamber when the machine stops running effectively prevents the yarn from accidental thermal damage.

What is claimed is:

1. Apparatus for drying sheets of yarn, comprising:

a substantially enclosed drying chamber elongated in the running direction of said yarn sheet and having openings to permit the free passage of said yarn sheet therethrough;

an air suction duct having an upstream portion and a downstream portion, said upstream portion of said air suction duct communicating with a downstream portion of said drying chamber;

an air exhaust duct including a fan, said air exhaust duct communicating with said downstream portion of said air suction duct;

an air circulating duct having an upstream and a downstream portion, said upstream portion of said air circulating duct communicating with said air suction duct, said downstream portion of said air circulating duct communicating with an upstream portion of said drying chamber;

first air flow control means for controlling air flow between said air circulation duct and said air suction duct, said first air flow control means to prevent air flow between said air circulation duct and said air suction duct when said yarn sheet is stationary within said drying chamber, said first air flow control means to permit air flow between said air circulation duct and said air suction duct when said yarn sheet is moving through said drying chamber at a satisfactory speed;

heater means for supplying thermal energy to said air circulating duct at a point intermediate the point at which said air circulation duct communicates with said air suction duct and the point at which said air circulation duct communicates with said drying chamber;

a cool air supply duct communicating with said air circulation duct at a point intermediate the point at which said heater means supplies thermal energy to said air circulation duct and the point at which said air circulation duct communicates with said drying chamber;

second air flow control means for controlling air flow between said cool air supply duct and said air circulating duct, said second air flow control means to permit air flow between said cool air supply duct and said air circulating duct when said yarn sheet is stationary within said drying chamber, said second air flow control means to prevent air flow between said cool air supply duct and said air circulating duct when said yarn sheet is moving through said drying chamber at a satisfactory speed; and an air circulating fan located in said air circulating duct at a point intermediate the point at which said cool air duct communicates with said air circulating duct and the point at which said air circulating duct communicates with said drying chamber, said air circulating fan to circulate air in a direction from said air circulating fan to the point at which said air circulating duct communicates with said drying chamber.

2. Apparatus in accordance with claim 1, further including means for controlling the rate of air flow through said air circulation duct when said yarn sheet is moving through said drying chamber at a satisfactory speed.

3. Apparatus in accordance with claim 1, wherein said first air flow control means comprises a swingable deflector disposed at the point at which said air circulation duct communicates with said air suction duct, said swingable deflector movable between a first position which prevents air flow between said air circulation duct and said air suction duct when said yarn sheet is stationary within said drying chamber and a second position wherein said swingable deflector permits air flow between said air circulation duct and said air suction duct when said yarn sheet is moved through said drying chamber at a satisfactory speed.

4. Apparatus in accordance with claim 1, wherein said second air flow control means comprises a swingable deflector disposed at the point at which said cool air supply duct communicates with said air circulating duct, said swingable deflector being movable between a first position wherein said swingable deflector permits air flow between said cool air supply duct and said air circulating duct when said yarn sheet is stationary within said drying chamber and a second position wherein said swingable deflector prevents air flow between said cool air supply duct and said air circulating duct when said yarn sheet is moving through said drying chamber at a satisfactory speed.

5. Apparatus in accordance with claim 1, wherein said heater means comprises a heater located within said air circulating duct at a point located between the point at which said air suction duct communicates with said air circulating duct at a point at which said air circulating duct communicates with said cool air supply duct.

6. Apparatus in accordance with claim 1, wherein a frame confining said drying chamber can be opened for introduction of outside air.

7. Apparatus as in claim 2, wherein said means for controlling the rate of air flow through said air circulation duct comprises a swingable deflector located in said air circulation duct.

8. Apparatus for drying sheets of yarn, comprising:

a substantially enclosed drying chamber elongated in the running direction of said yarn sheet and having openings to permit the free passage of said yarn sheet therethrough;

an air suction duct having an upstream portion and a downstream portion, said upstream portion of said air suction duct communicating with a downstream portion of said drying chamber;

an air exhaust duct including a fan, said air exhaust duct communicating with said downstream portion of said air suction duct;

an air circulation duct having an upstream and a downstream portion, said upstream portion of said air circulation duct communicating with said air suction duct, said downstream portion of said air circulation duct communicating with an upstream portion of said drying chamber;

a first swingable deflector positioned at the point at which said air suction duct communicates with said air circulation duct and movable between a first position wherein said first swingable deflector prevents air flow between said air circulation duct and said air suction duct when said yarn sheet is stationary within said drying chamber and a second position wherein said first swingable deflector permits air flow between air circulation duct and said air suction duct when said yarn sheet is moving through said drying chamber at a satisfactory speed;

heater means for supplying thermal energy to said air circulation duct at a point intermediate said upstream and downstream portions of said air circulation duct;

a cool air supply duct communicating with said air circulation duct at a point intermediate the point at which said heater means supplies thermal energy to said air circulation duct and the point at which said air circulation duct communicates with said drying chamber;

a second swingable deflector located at the point at which said cool air supply duct communicates with said air circulation duct, said second swingable deflector being swingable between a first position wherein said second swingable deflector permits air flow between said cool air supply duct and said air circulating duct when said yarn sheet is stationary within said drying chamber and a second position wherein said second swingable deflector prevents air flow between said cool air supply duct and said air circulating duct when said yarn sheet is moving through said drying chamber at a satisfactory speed; and an air circulating fan located in said air circulating duct at a point intermediate the point at which said cool air supply duct communicates with said air circulating duct and the point at which said air circulating duct communicates with said drying chamber, said air circulating fan to circulate air in a direction from said air circulating fan towards the point at which said air circulating duct communicates with said drying chamber.

9. Apparatus as in claim 8, further including means for controlling the rate of air flow through said air circulation duct when said yarn sheet is moving through said drying chamber at a satisfactory speed.

10. Apparatus as in claim 8, wherein said heater means is a heater located in said air circulation duct at a point between the point at which said air circulation duct communicates with said air suction duct and the point at which said air circulation duct communicates with said cool air supply duct.

11. Apparatus as in claim 8, wherein said means for controlling the rate of air flow through said air circulation duct comprises a third swingable deflector located in said air circulation duct.

* * * * *